United States Patent [19]

Goodrich

[11] 4,188,857

[45] Feb. 19, 1980

[54] RECIPROCATING PNEUMATIC SANDING AND RUBBING MACHINE

[76] Inventor: Robert S. Goodrich, 27901 S. Golden Meadow Dr., Ranchos Palos Verdes, Calif. 90274

[21] Appl. No.: 903,938

[22] Filed: May 8, 1978

[51] Int. Cl.[2] ..... F01L 31/18; F15B 11/16; F01B 9/00; F01B 7/00

[52] U.S. Cl. ..... 91/352; 91/533; 92/136; 92/151

[58] Field of Search ..... 92/136, 151; 91/352, 91/533; 51/170 TL

[56] References Cited

U.S. PATENT DOCUMENTS

| | | | |
|---|---|---|---|
| 1,780,329 | 11/1930 | Bard | 92/136 |
| 2,376,009 | 5/1945 | Sacchini et al. | 92/136 |
| 2,983,256 | 5/1961 | Seeloff | 92/151 |
| 3,131,606 | 5/1964 | Oelke | 92/151 |
| 3,485,141 | 12/1969 | Ott et al. | 92/151 |
| 3,563,134 | 2/1971 | Rodstein | 91/349 |

*Primary Examiner*—Paul E. Maslousky
*Attorney, Agent, or Firm*—Edward A. Sokolski

[57] ABSTRACT

A reciprocating sanding and rubbing machine has a shoe portion to which the sanding or rubbing member is attached, this shoe portion being connected through a rack and pinion drive gear assembly to a symmetrically balanced piston assembly which is reciprocally driven by a pneumatic drive. The piston assembly is greater in length than half the total length of the tool, and moves in a carriage block reciprocally relative to the shoe. Two pistons and two associated pairs of compression chambers are employed, one of these pairs of chambers being used for drive in one direction, and the other pair being used for drive in an opposite direction. The pistons are supported on sleeve bearings which align them within the cylinder chamber, thereby minimizing wear on the pistons and the cylinder walls. Reciprocating motion of the piston is achieved by means of pneumatic valving arrangement employing a rotatable valving member which is driven by a rack and pinion gear assembly in response to motion of the shoe. The pneumatic drive is fed through the valving arrangement in a lateral direction, and venting is also achieved laterally so as to eliminate downward pressure on the components of the tool which would tend to contribute friction.

4 Claims, 14 Drawing Figures

RECIPROCATING PNEUMATIC SANDING AND RUBBING MACHINE

This invention relates to pneumatic hand operated sanders and rubbing tools, and more particularly to such a tool in which straight line reciprocating motion is imparted to a shoe carried by the tool.

Sanders and rubbing tools which employ sole plates or shoes that are reciprocally driven by a pneumatic piston have been known for some time in the prior art, and are shown for example in my prior U.S. Pat. No. 3,713,365 issued Jan. 30, 1973; U.S. Pat. No. 3,563,134 issued Feb. 16, 1971 to Rodstein; U.S. Pat. No. 3,214,823 issued Nov. 1965, to Hendrickson; and U.S. Pat. No. 2,681,042 issued June 15, 1954 to Larson. In tools of this type, it is important that the operating parts be simple, sturdy, dependable and easily maintained. Since tools of this type operate at high speed, it is also desirable that there be a minimum of vibration, bucking, and oscillation, all of which make it difficult for an operator to operate the tool and causes considerable discomfort, particularly if the tool is to be operated for any significant period of time.

The present invention provides an improvement over prior art devices with regard to the various factors mentioned above. First, vibration and bucking is minimized by using a symmetrically balanced piston assembly and carrier wherein the piston assembly is more than one half the length of the machine and is located symmetrically to assure balanced operation. Further, bearings are provided for the pistons to minimize friction and chatter thereof. Also, a double ended pair of pistons, each with an associated pair of compression chambers, are used for the drive in each direction to provide increased speed and power. Further, the pneumatic input and vented outputs are fed to the valves laterally, i.e. in the general directions of the piston travel rather than normal to these directions (as is the case in many prior art devices), thereby avoiding downward pressure from the pneumatic streams on the carriage and its associated bearing components which would contribute to friction.

It is therefore an object of this invention to provide a pneumatic sanding and rubbing machine which has smoother, lower vibration operation than prior art devices.

It is a further object of this invention to provide a sanding and rubbing machine which is more reliable and easier to maintain than prior art devices of this type.

It is still another object of this invention to provide a sanding and rubbing machine which has higher power and speed than comparable devices of the prior art.

It is still another object of this invention to provide a sanding and rubbing machine which is more efficient in its operation than prior art devices.

Other objects of this invention will become apparent from the following description taken in connection with the accompanying drawings, of which:

Briefly described, the device of my invention is as follows:

A piston assembly having a length which is greater than half the length of the entire tool is mounted for reciprocal motion on suitable bearings within a carriage block. A shoe or sole plate member is also reciprocally mounted on this block and is coupled by a linear rack and pinion gear train to the central portion of the piston assembly. The piston assembly is symmetrically balanced and has a first piston and an associated pair of compression chambers on the opposite sides thereof positioned on one side of the centrally located drive rack, and a second similar piston and associated pair of compression chambers on the other side of this rack. A rotatable pneumatic valving arrangement which is driven by the sole plate or shoe by means of a rack and pinion gear assembly is used to control the pneumatic feed to the pistons to effect the reciprocating motion thereof. This valve receives the pneumatic stream in a direction generally parallel to the travel of the piston, such that there is minimal downward pressure on the valve which would tend to contribute to friction. Pneumatic drive is first fed through the valve to a first pair of compression chambers to drive the pistons in a first direction, and then when the end of travel in this direction is reached, the rack and pinion gear has driven the valve so that it now feeds the pneumatic stream to a second pair of compression chambers on the other sides of the pistons, thereby effecting the drive thereof in an opposite direction.

Figure 1:
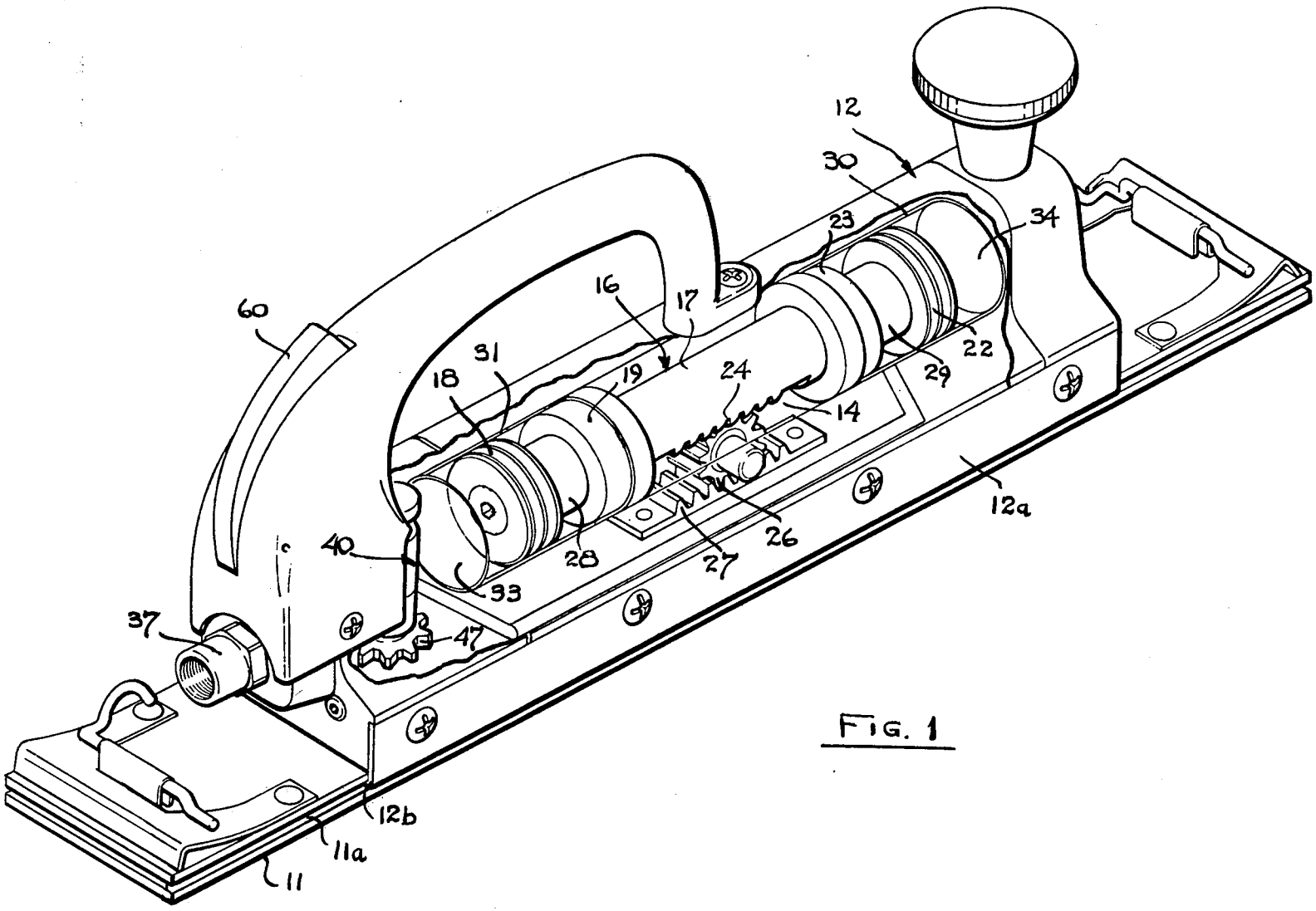
FIG. 1 is a perspective view with cutaway section illustrating a preferred embodiment of the invention.
Figure 2:
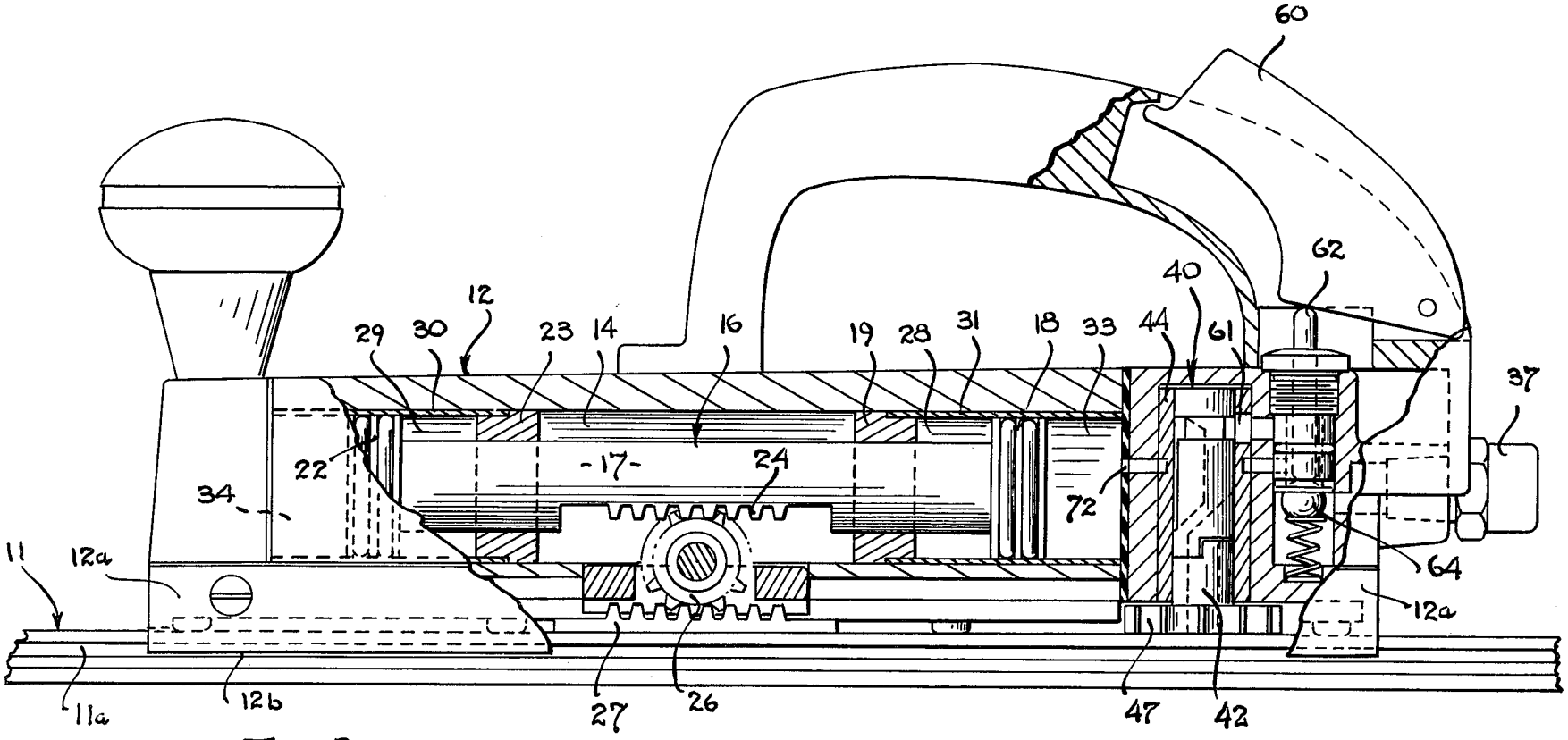
FIG. 2 is a side elevational view partially in cross-section of the preferred embodiment.
Figure 3:
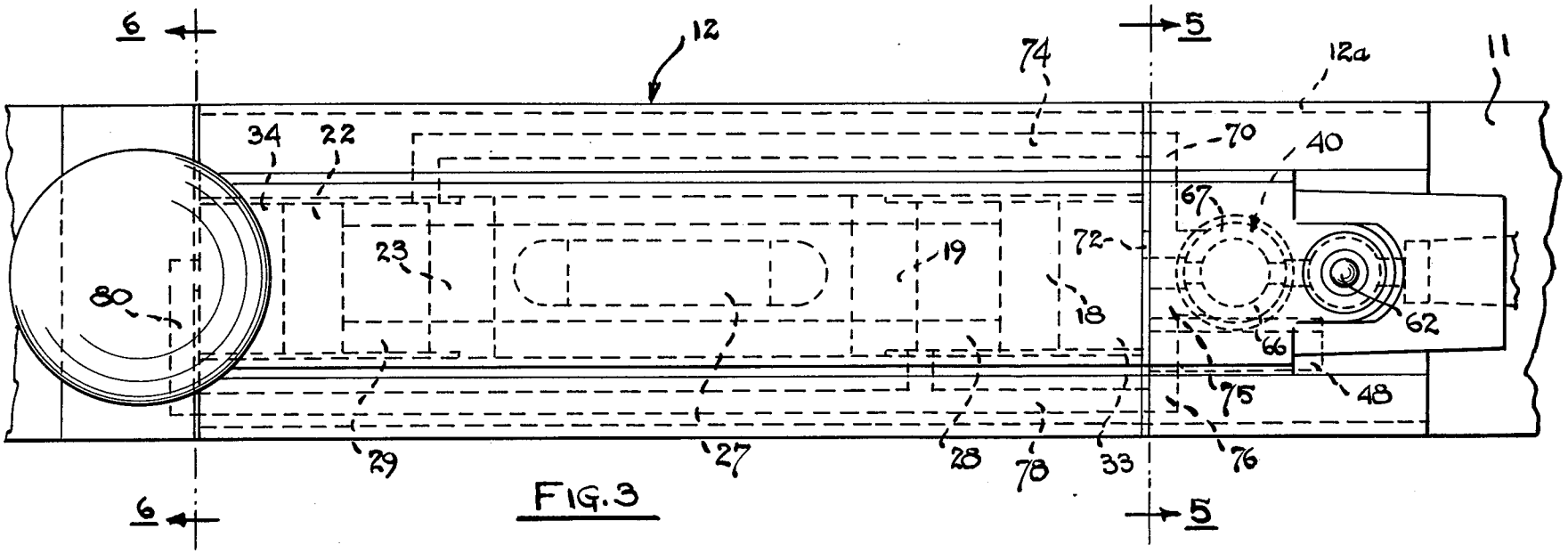
FIG. 3 is a top plan view of the preferred embodiment with the handle omitted for convenience of illustration.
Figure 4:
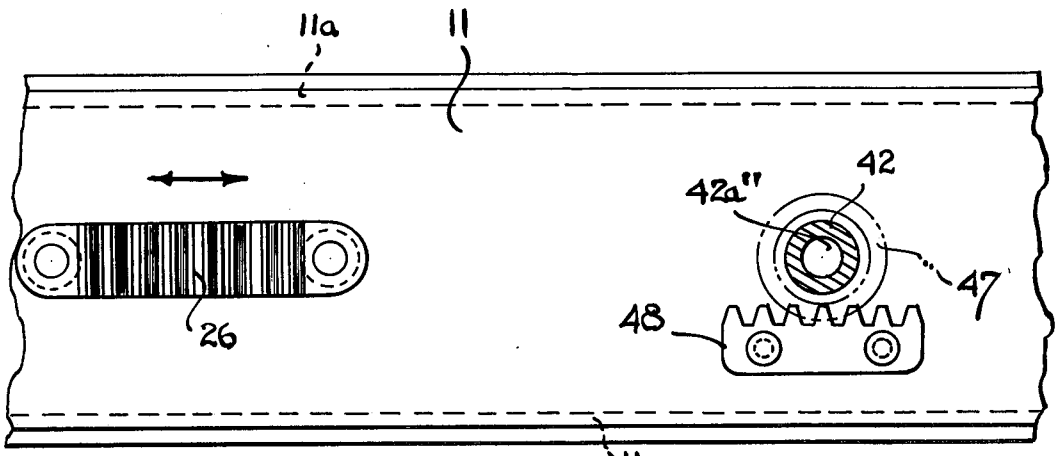
FIG. 4 is a top plan view showing a portion of the shoe or sole plate of the preferred embodiment.
Figure 5:
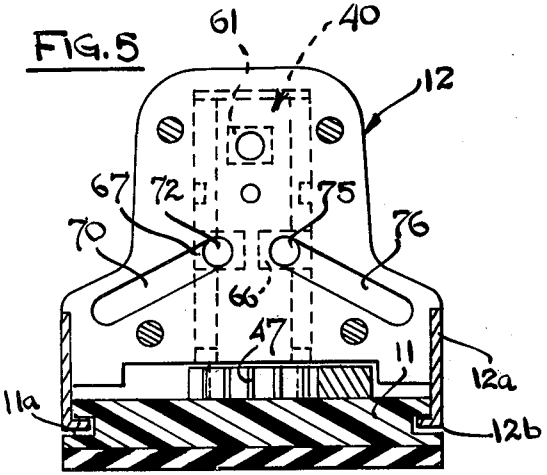
FIG. 5 is a cross-sectional view taken along the plane indicated by 5—5 in FIG. 3.
Figure 6:
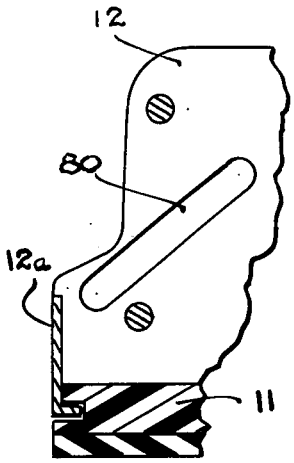
FIG. 6 is a cross-sectional view taken along the plane indicated by 6—6 in FIG. 3.
Figure 7:
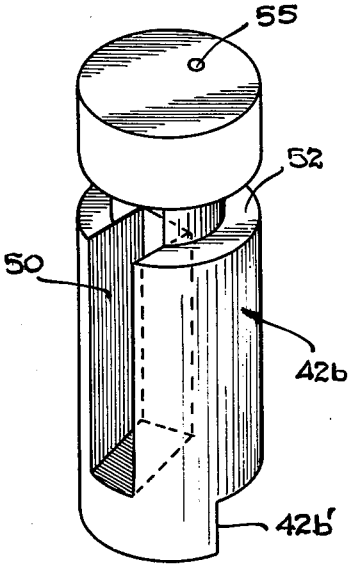
FIG. 7 is a perspective view illustrating the rotatable portion of the pneumatic valve of the preferred embodiment.
Figure 8:
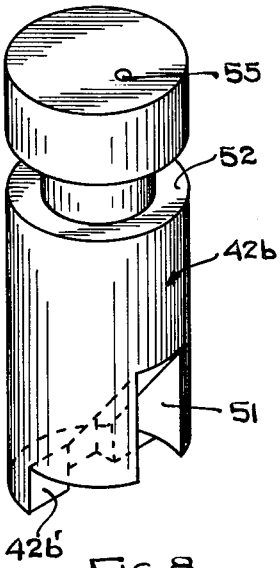
FIG. 8 is a perspective view of the pneumatic valve of FIG. 7 taken from a side opposite to that of FIG. 7.
Figure 9:
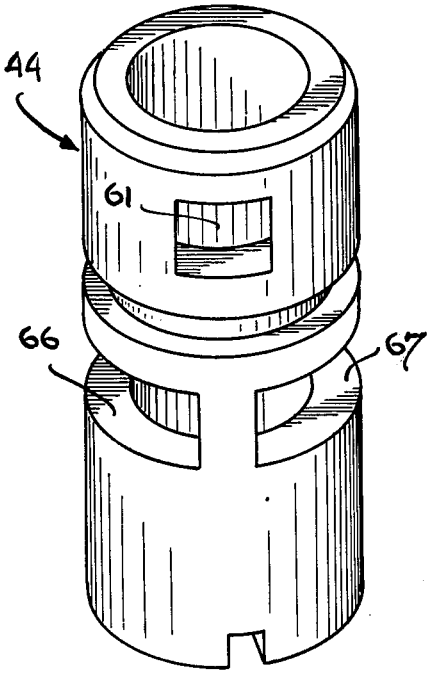
FIG. 9 is a perspective view of the stationary portion of the pneumatic valve assembly of the preferred embodiment.

Referring now to FIGS. 1, 2–6, a preferred embodiment of the invention is shown with portions cut away in some of these views for convenience of illustration. A shoe 11 is slidably mounted on the side wall portions 12*a* of carriage 12, bent over portions 12*b* of the carriage side wall being fitted into grooves 11*a* of the shoe. Slidably supported in chamber 14 formed in the carriage is a piston assembly 16. The piston assembly 16 has a shaft 17 with a first piston 18 being attached thereto towards one end thereof, and a second piston 22 being attached thereto towards the other end thereof. Shaft 17 is slidably supported on sleeve bearings 19 and 23 which are press fitted into the bore of the carriage. The central portion of shaft 17 has a gear rack 24 formed in the bottom portion thereof. A first pair of compression chambers 28 and 33 are formed on the opposite sides of piston 18, and a second pair of compression chambers 29 and 34 are formed on the opposite sides of piston 22. Gear rack 24 meshes with pinion gear 26, rotatably carried on the carriage 12, which in turn engages rack gear 27, which is fixedly attached to shoe 11. Sleeves 30 and 31 which can best be seen in FIG. 2 are force fitted on bearings 23 and 19 respectively, to provide improved bearing surfaces for the pistons, holes (not shown) being provided in these sleeves to permit the passage of air to the inner compression chambers 28 and 29.

A pneumatic stream is fed to the device by a hose (not shown) which is attached to coupling 37, the fluid being fed from this coupling to valve assembly 40 which has a centrally located cylindrical portion 42 which is rotatably mounted within a cylindrical chamber formed by stationary cylindrical sleeve 44, which is press fitted into the carriage. The bottom of cylindrical valve member 42 meshes with pinion gear 47 in an interfitted relationship as described below. Pinion gear 47 engages a linear rack 48 which is fixedly attached to shoe 11.

Figure 10:
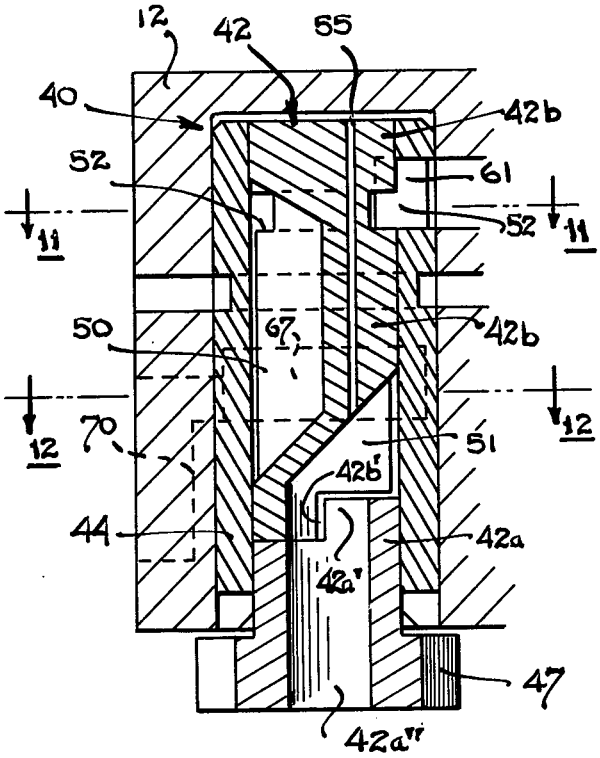
FIG. 10 is a cross-sectional view illustrating the pneumatic valve assembly of the preferred embodiment installed in the machine.

As can best be seen in FIG. 10, the inner rotatably cylindrical valve portion 42 is formed in two parts, the lower part 42*a* having a top leg portion 42*a'* which mates with a corresponding bottom leg portion 42*b'* in upper part 42*b*. Valve portion 42*a* has a hollow center 42*a''*, while valve portion 42*b* has a number of grooved portions 50, 51 and 52 formed therein. Grooves 50 and 52 operate to properly feed the pneumatic stream to various piston portions at various times during the operating cycle, and groove 51 provides an opening to exhaust the pneumatic stream through the hollow center 42*a''* of valve portion 42*a*, as to be explained further on in the specification in connection with FIGS. 11–14. Valve portion 42 is also drilled with an exhaust hole 55 leading from the top of the valve to groove 51, for the purpose of providing an exhaust port for any fluid on top of the valve, as hereinafter described.

The device is operated by depressing handle actuator portion 60 which, as best shown in FIG. 2, in turn drives plunger 62 downwardly and opens a valve by downwardly deflecting spring urged ball member 64, which functions to close the valve. This puts into play a starting mechanism which assures displacement of the piston from a null position, this mechanism being fully described in my aforementioned U.S. Pat. No. 3,713,365.

Figure 11:
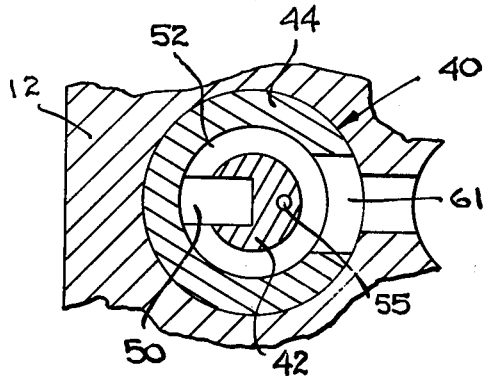
FIG. 11 is a cross-sectional view taken along the plane indicated by 11—11 in FIG. 10.
Figure 12:
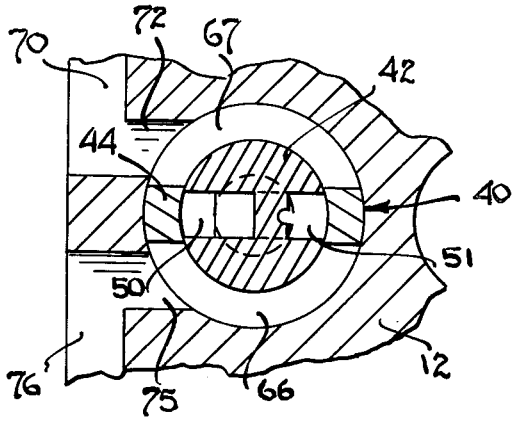
FIG. 12 is a cross-sectional view taken along the plane indicated by 12—12 in FIG. 10.
Figure 13:
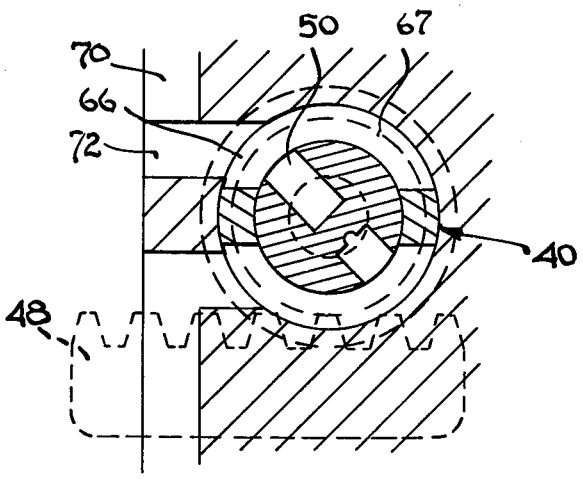
FIG. 13 is a cross-sectional view showing the valve assembly in its position for driving the piston in a first direction.

A pneumatic stream is fed to window 61 of sleeve 44, this pneumatic stream being channeled through annular groove 52 of the central member 42 to vertical groove 50 of this member, as can best be seen in FIG. 11. As can be seen, when in the position shown in FIG. 11 the piston is in a null position, such that the valve is closed. This situation is remedied by the action of the starter which moves the piston off null such that rack 48 drives the valve in a direction to provide a pneumatic feed, as indicated in FIG. 13, through slot 67 which is in fluid communication with aperture 72 formed in the carriage block. Aperture 72 is in direct fluid communication with compression chamber 33 and thus provides forward pneumatic drive to piston 18. A portion of the pneumatic stream is also fed through groove 70 to pneumatic channel 74 formed in the carriage block which is connected to compression chamber 29, this providing forward pneumatic drive for piston 22 (see FIG. 3). When the piston assembly and shoe reach the end of their travel, the rack 48 has driven the valve to the position indicated in FIG. 14, whereat the pneumatic stream will be fed from groove 50 to groove 66 to aperture 75 from where it is fed through slot 76 to pneumatic channel 78 formed in the carriage block. Channel 78 is connected both to compression chamber 28 and slot 80 formed in the carriage block, slot 80 being connected to compression chamber 34. The pneumatic drive is thus fed against the faces of pistons 18 and 22 opposite to those driven during the forward drive portion of the cycle, thereby effecting a reverse piston drive. This cycle is repeated over and over again so as to provide a reciprocating motion of the piston and shoe.

Figure 14:
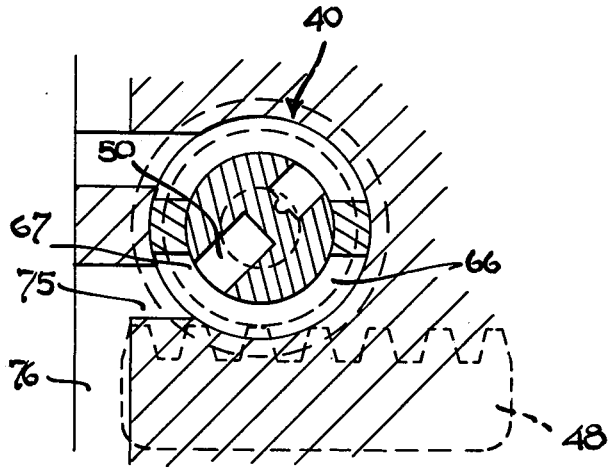
FIG. 14 is a cross-sectional view showing the valve in position for driving the piston in a reverse direction.

The respective ducting described above for supplying the pneumatic stream of fluid to drive the piston assembly also functions to provide an exhaust path for the fluid when the piston assembly is driven in the opposite direction, as should be easily understood. The exhaust fluid is ported through groove 66 when the piston assembly is driven in one direction, as shown in FIG. 13, and through groove 67 when the piston assembly is driven in the opposite direction as shown in FIG. 14. In both instances, the fluid is ported through groove 51 and then through the hollow center 42*a''* of valve portion 42*a*, where at the base of which the fluid is exhausted into the atmosphere.

While the pneumatic fluid is being supplied to the piston assembly, some of the fluid may pass between the annular wall of outer sleeve 44 and the wall of the valve housing in the carriage 12 to the opening or chamber between the top of valve 42 and the valve housing. If the fluid were not exhausted, the pressure of the fluid would depress valve 42 and in turn cause gear 47 to be pressed against the shoe, which would increase the friction on the shoe. The provision of hole 55 prevents this, as any fluid that escapes into the chamber above valve 42 is exhausted through hole 55 into groove 51, whereupon it is then exhausted into the atmosphere through the hollow portion 42*a''* of the lower portion of the valve.

While the invention has been described and illustrated in detail, it is to be clearly understood that this is intended by way of illustration and example only and is not to be taken by way of limitation, the spirit and scope of this invention being limited only by the terms of the following claims.

I claim:

1. A reciprocating sanding and rubbing machine comprising a carriage block having an elongated compartment formed therein, a piston assembly slidably mounted in said compartment, said piston assembly being greater in length than half the overall length of said machine and including a central shaft, gear means at the central portion of said shaft, first and second pistons positioned in symmetrical relationship on said shaft on opposite sides of said gear means, and a pair of sleeve bearings having substantially the same outer diameter as said pistons fixedly and tightly mounted in said carriage block in symmetrical relationship on opposing sides of said gear means between said pistons and said gear means, whereby pneumatic compression chambers are formed between one face of each of the pistons and the sleeve bearing on each side of the gear means and between the other face of each of said pistons and a corresponding end wall of said compartment, valve means for alternately feeding a pneumatic stream to a first pair of said compression chambers to drive pistons in a first direction and to a second pair of said compression chambers to drive the pistons in an opposite direction, a shoe member slidably mounted on said carriage block, gear means mounted on said shoe member and coupled to said first gear means whereby said shoe member is driven along said carriage in reciprocal relationship to the motion of the pistons, and gear means for coupling the shoe member to the valve means to retatably oscillate said valve means whereby an air stream is alternately fed first to one face of each of the pistons and then to the other face of each of the pistons.

2. The machine of claim 1 wherein the valve means is adapted to receive the pneumatic drive stream in a direction substantially parallel to the longitudinal axis of the valve assembly, thereby minimizing downward frictional pressure on the machine.

3. The machine of claim 1 wherein the pistons are mounted on the opposite ends of said shaft.

4. The machine of claim 1 wherein all of the gear means are rack and pinion gear assemblies.

* * * * *